US007587830B2

(12) United States Patent
Nordlin

(10) Patent No.: US 7,587,830 B2
(45) Date of Patent: Sep. 15, 2009

(54) KNOCKOUT PUNCH WITH PILOT HOLE LOCATOR

(75) Inventor: William F. Nordlin, Poplar Grove, IL (US)

(73) Assignee: Textron Innovations Inc., Providence, RI (US)

( * ) Notice: Subject to any disclaimer, the term of this patent is extended or adjusted under 35 U.S.C. 154(b) by 582 days.

(21) Appl. No.: 11/103,296

(22) Filed: Apr. 11, 2005

(65) Prior Publication Data

US 2006/0016312 A1 Jan. 26, 2006

Related U.S. Application Data

(62) Division of application No. 10/085,730, filed on Feb. 28, 2002, now Pat. No. 6,973,729.

(51) Int. Cl.
*B26F 1/14* (2006.01)

(52) U.S. Cl. ..... 30/360; 30/362; 30/366; 83/685

(58) Field of Classification Search ..... 30/360, 30/362, 366; 83/681, 689, 684–686, 696, 83/743, 745, 690, 631; 408/211–213, 224, 408/102

See application file for complete search history.

(56) References Cited

U.S. PATENT DOCUMENTS 161,968 A 4/1875 Kennedy
1,721,007 A 7/1929 Doherty et al.
1,817,223 A * 8/1931 Abramson et al. ..... 30/360
2,096,778 A 10/1937 Azer
2,145,725 A 1/1939 Jamieson
2,176,943 A 10/1939 Reeser (Continued)

FOREIGN PATENT DOCUMENTS

DE 19613153 10/1997

(Continued)

OTHER PUBLICATIONS

Five pages from Greenlee Catalog No. 79 issued in Sep. 1979—Timesaving Tools for Electricians, Maintenance Men and Industry.

(Continued)

*Primary Examiner*—Boyer D. Ashley
*Assistant Examiner*—Phong Nguyen
(74) *Attorney, Agent, or Firm*—Trexler, Bushnell, Giangiorgi, Blackstone & Marr, Ltd.

(57) ABSTRACT

A knockout punch is provided with a member such that when the punch and the die are drawn together by the draw stud to make a hole in a workpiece, the member on the punch will locate the punch assembly in a pilot hole. In three embodiments of the invention, the member is formed integrally with the punch and extends from the punch proximate to a bore in the punch which is used to connect the punch to the draw stud. In another embodiment of the invention, the member is provided as an insert which is connected to the punch within a counterbore. The punch is also provided with a pair of piercing portions for piercing through the workpiece after the member has centered the punch assembly with the pilot hole and a pair of cutting portions for shearing the workpiece after the piercing portions have pierced the workpiece.

18 Claims, 7 Drawing Sheets

U.S. PATENT DOCUMENTS

| | | | | |
|---|---|---|---|---|
| 2,237,069 | A | | 4/1941 | Christenson |
| 2,341,187 | A | * | 2/1944 | Menger et al. ..... 72/345 |
| 2,735,489 | A | | 2/1956 | Fowler |
| 3,255,526 | A | | 6/1966 | Molitor |
| 3,269,011 | A | | 8/1966 | Herrstrum |
| 3,683,499 | A | | 8/1972 | Robinson, Jr. |
| 3,728,927 | A | | 4/1973 | Pfleiderer et al. |
| 3,800,419 | A | | 4/1974 | Hughes, Jr. |
| 4,087,913 | A | | 5/1978 | Jackson |
| 4,353,164 | A | | 10/1982 | Linquist et al. |
| 4,403,417 | A | | 9/1983 | Wilson et al. |
| 4,543,722 | A | | 10/1985 | Adleman et al. |
| 4,594,779 | A | | 6/1986 | Hagemeyer |
| 4,724,616 | A | | 2/1988 | Adleman et al. |
| 4,739,687 | A | | 4/1988 | Wanner et al. |
| 4,830,548 | A | | 5/1989 | Kandarian |
| 4,899,447 | A | | 2/1990 | Adleman |
| 4,905,557 | A | | 3/1990 | Adleman |
| 4,989,484 | A | * | 2/1991 | Johnson et al. ..... 83/140 |
| 5,029,392 | A | | 7/1991 | Bingham et al. |
| 5,727,436 | A | | 3/1998 | Swedberg et al. |

FOREIGN PATENT DOCUMENTS

| | | |
|---|---|---|
| DE | 19803814 | 8/1999 |

OTHER PUBLICATIONS

Ten pages from Greenlee Catalog MA-1024—Nov. 1993—Tools Testers, and Accessories.

* cited by examiner

KNOCKOUT PUNCH WITH PILOT HOLE LOCATOR

CROSS-REFERENCE

This patent application is a divisional of U.S. patent application Ser. No. 10/085,730, filed Feb. 28, 2002, and entitled "Knockout Punch With Pilot Hole Locator".

BACKGROUND OF THE INVENTION

The present invention relates to an improved knockout punch which is used in conjunction with a punch driver to punch holes in sheet metal, for example, in the walls of electrical cabinets, aluminum, fiberglass and plastic.

Generally, when a hole is to be punched in an electrical cabinet, a small hole is first drilled in the wall of the electrical cabinet. A first end of a draw stud is threaded into a ram of a hydraulic punch driver. A second end of the draw stud is inserted through a punching die and then through the drilled hole, the draw stud having a circumference that is less than the circumference of the drilled hole. A knockout punch is threaded onto the second end of the draw stud on the opposite side of the electrical cabinet than is the punching die and the hydraulic punch driver.

An operator actuates a hand pump of the hydraulic punch driver. When the hand pump of the hydraulic punch driver is actuated, hydraulic fluid forces the ram to pull the draw stud. The draw stud, in turn, pulls the knockout punch through the electrical cabinet into the die such that the desired hole size is punched.

Knockout punches used in the prior art, such as standard round knockout punches, SLUG BUSTER® knockout punches sold by Greenlee Textron Inc., the assignee of the present invention, and those embodied in U.S. Pat. No. 4,353,164, which is owned by Greenlee Textron Inc., the assignee of the present invention, while proving very effective in the marketplace, suffer from a number of disadvantages.

One such disadvantage is that the prior art knockout punches do not provide means for locating the punch assembly in a pilot hole as the knockout punch and the die are drawn together by the draw stud to make a hole in the workpiece. Presently, an operator locates the punch assembly in a pilot hole by using "alignment marks" which can be difficult to see by the operator and may allow for error such that the hole to be created may not be properly positioned.

Another such disadvantage is that the prior art knockout punches typically have an elevated punching force at the beginning as the punch pierces the workpiece because the punch is working against a large length of the workpiece before the points of the punch fully pass through the workpiece.

Yet another such disadvantage is that the prior art knockout punches typically have an elevated punching force at the end of the punching cycle. The standard punch has a high punching force at the end of the punching cycle because it is shearing on four lines simultaneously and the angle of the punch faces reduces to zero at the end. The SLUG BUSTER® punch also has a high punching force at the end of the punching cycle because the long angled punch surfaces are "v" shaped, shearing on four lines simultaneously as the angle of the punch face reduces to zero toward the end of the punching cycle.

Another such disadvantage of the prior art knockout punches is that they do not have only planar surfaces which can be machined with standard cutting tools, such that custom formed tools or broaches are required to form the prior art knockout punches.

Thus, it is desirable to have a knockout punch which incorporates all of the advantages of the prior art knockout punches, but which overcomes the disadvantages of the prior art knockout punches, such as those identified above. The invention, as described herein, provides such a knockout punch. Other features and advantages of the knockout punch of the present invention will become apparent upon a reading of the attached specification in combination with a study of the drawings.

OBJECTS AND SUMMARY OF THE INVENTION

A primary object of the invention is to provide a knockout punch which improves punch alignment over prior art devices, such as the current difficult to see alignment marks.

An object of the invention is to provide a knockout punch which automatically locates on a drilled pilot hole.

Another object of the invention is to provide a knockout punch which reduces the initial piercing force.

Yet another object of the invention is to provide a knockout punch which reduces the punching force at the end of the punching cycle.

An object of the invention is to provide a knockout punch which is lower in cost to manufacture than those found in the prior art.

Another object of the invention is to provide a knockout punch which requires a lower punching force to punch holes through a workpiece.

Yet another object of the invention is to provide a knockout punch which has a longer life than those found in the prior art.

Still another object of the invention is to provide a knockout punch which has only planar surfaces, allowing it to be machined with standard cutting tools.

Briefly, and in accordance with the foregoing, a novel knockout punch is provided. The knockout punch has a pilot hole locator provided therewith such that when the knockout punch and the die are drawn together by the draw stud to make a hole in a workpiece, for instance an electrical cabinet, the pilot hole locator on the knockout punch locates the punch assembly in the pilot hole. In one embodiment of the invention, the pilot hole locator is formed integrally with the knockout punch and extends from the knockout punch proximate to a bore in the knockout punch which is used to connect the knockout punch to the draw stud. In another embodiment of the invention, the pilot hole locator is provided as an insert which is connected to the knockout punch within a counterbore. In either embodiment, the knockout punch is also provided with a pair of piercing portions for piercing through the workpiece after the pilot hole locator has centered the punch assembly with the pilot hole and a pair of cutting portions for shearing the workpiece after the piercing portions have pierced the workpiece.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
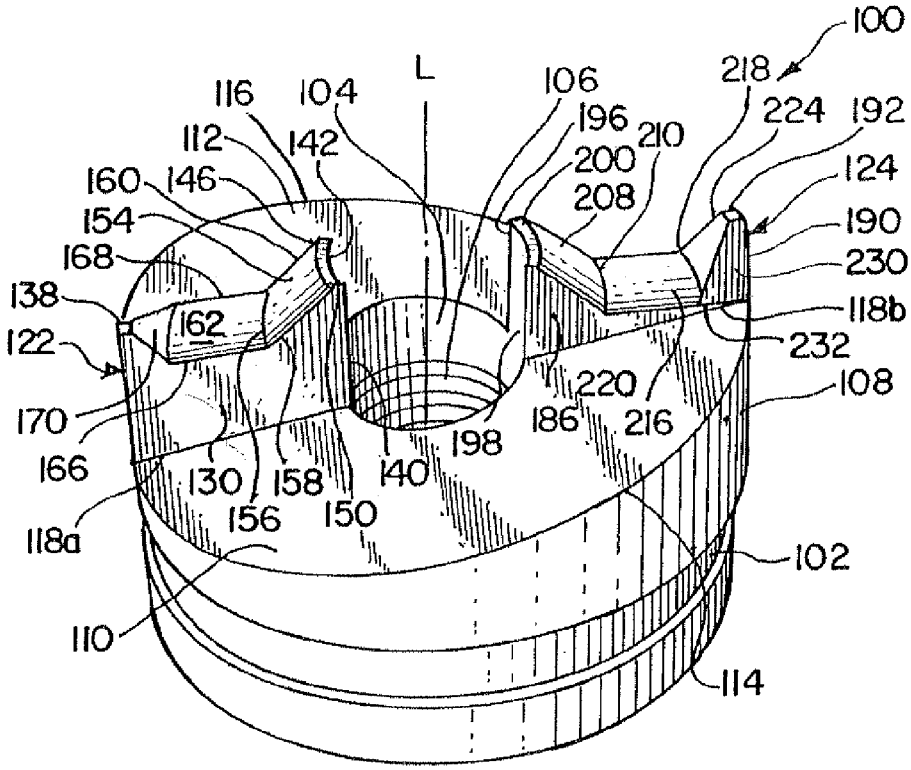
FIG. 1 is a perspective view of a first embodiment of a punch which incorporates features of the present invention.
Figure 2:
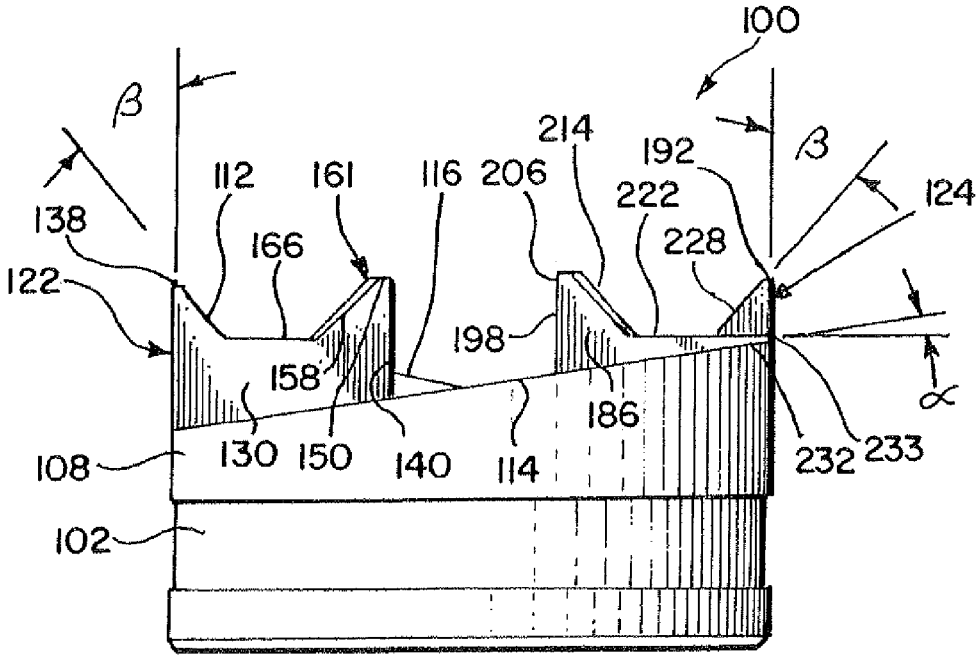
FIG. 2 is a side-elevational view of the punch of the first embodiment.
Figure 3:
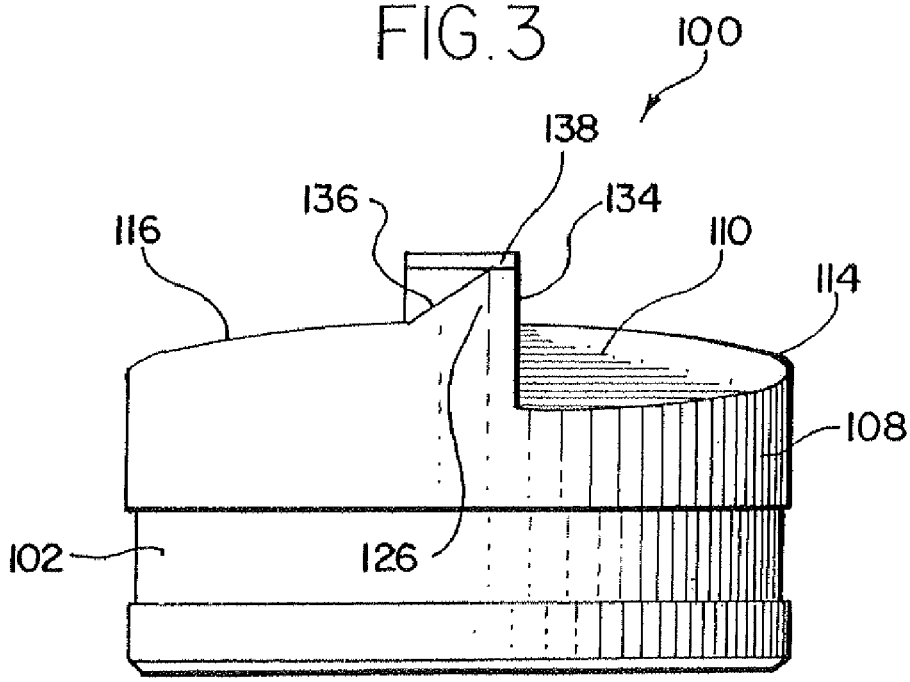
FIG. 3 is a side-elevational view of the punch of the first embodiment which is turned 90 degrees from the side-elevational view of the punch as illustrated in FIG. 2.
Figure 4:
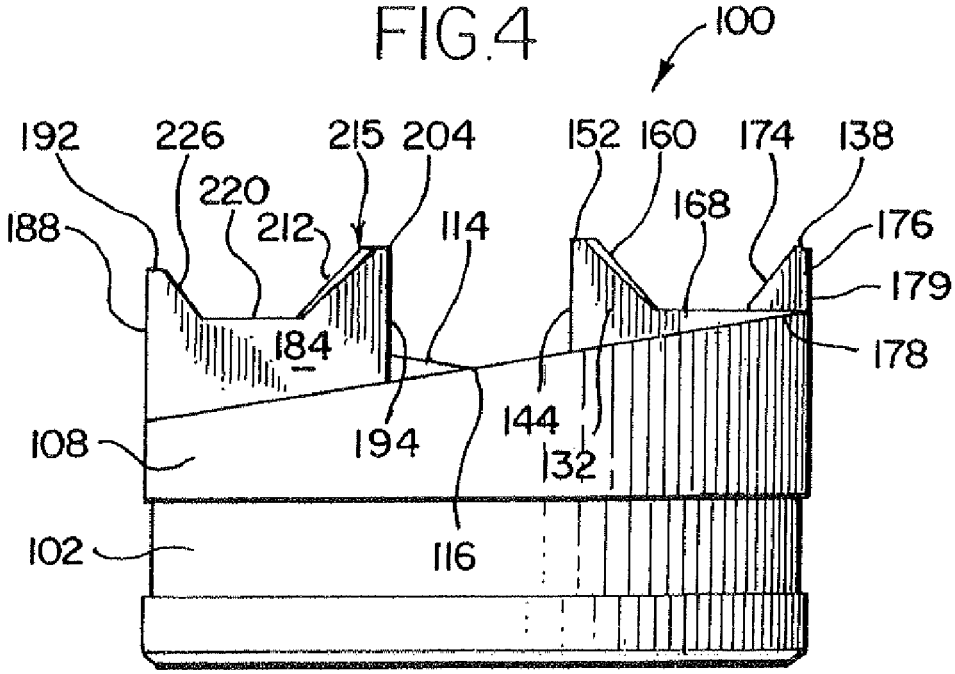
FIG. 4 is a side-elevational view of the punch of the first embodiment which is turned 180 degrees from the side-elevational view of the punch as illustrated in FIG. 2.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Figure 6:
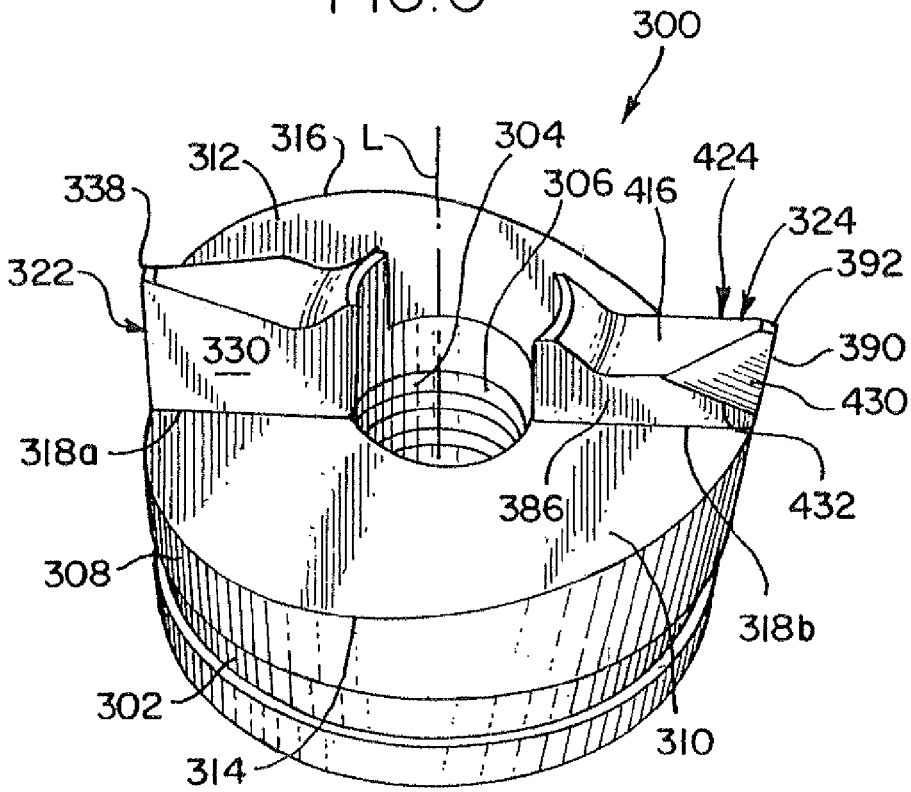
FIG. 6 is a perspective view of a second embodiment of the punch which incorporates features of the present invention.
Figure 7:
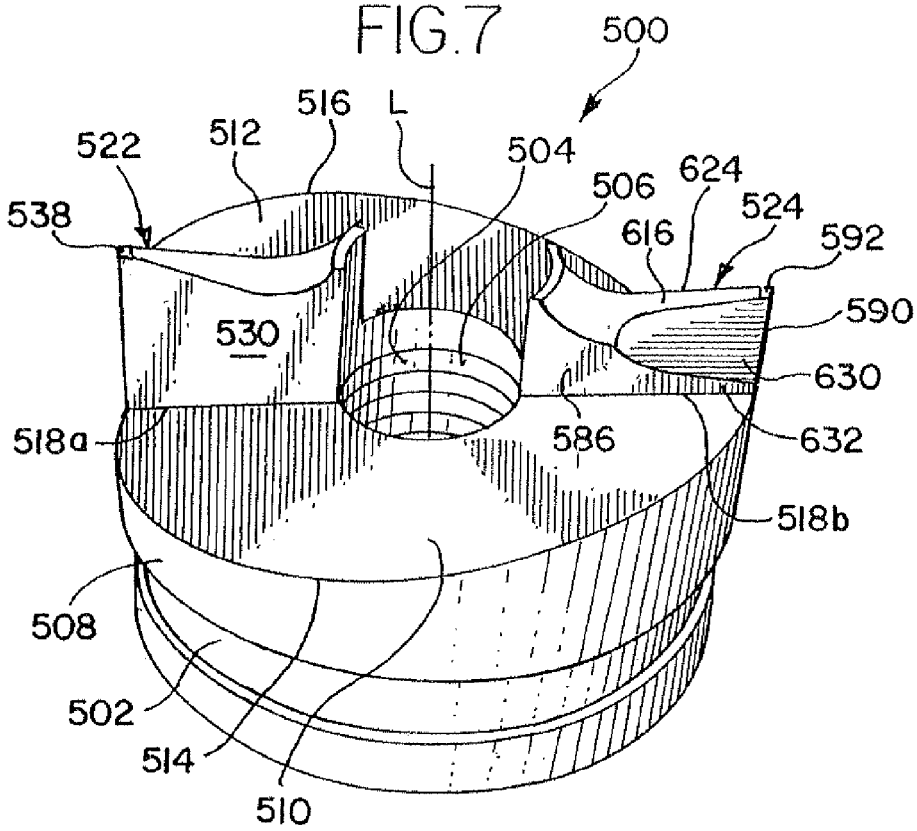
FIG. 7 is a perspective view of a third embodiment of the punch which incorporates features of the present invention.
Figure 8:
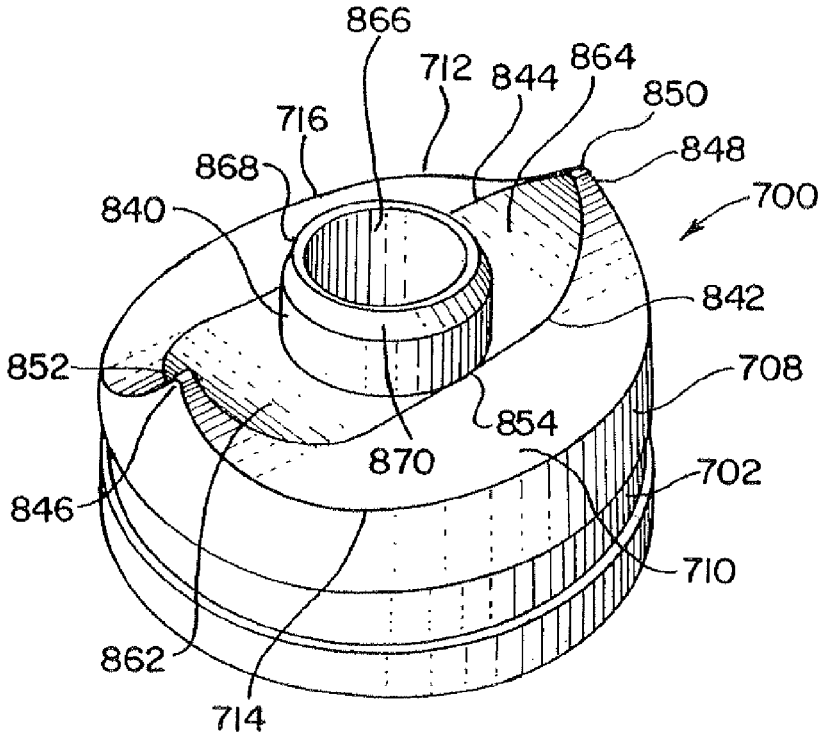
FIG. 8 is a perspective view of a fourth embodiment of the punch which incorporates features of the present invention.
Figure 9:
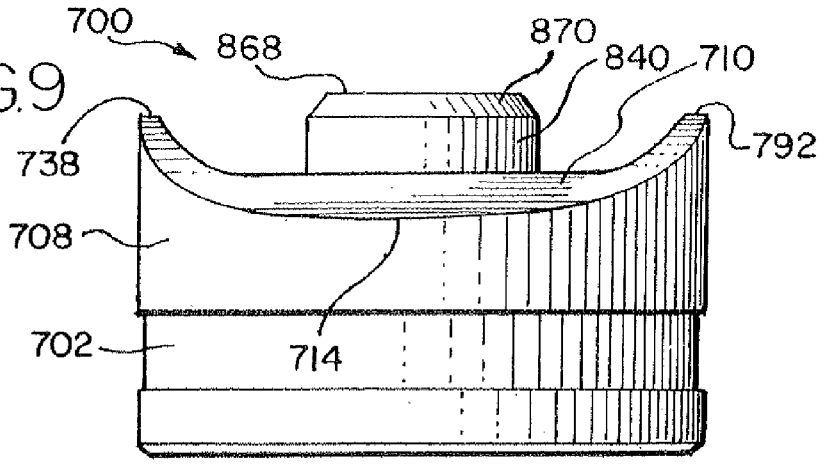
FIG. 9 is a side-elevational view of the punch of the fourth embodiment.
Figure 10:
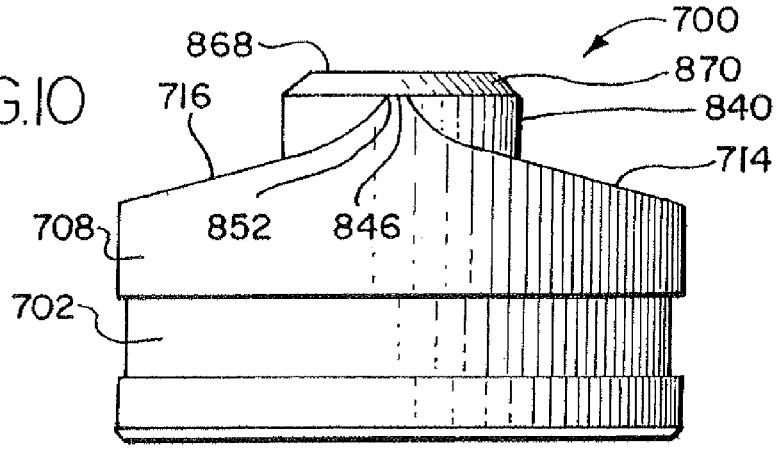
FIG. 10 is a side-elevational view of the punch of the fourth embodiment which is turned 90 degrees from the side-elevational view of the punch as illustrated in FIG. 9.
Figure 11:
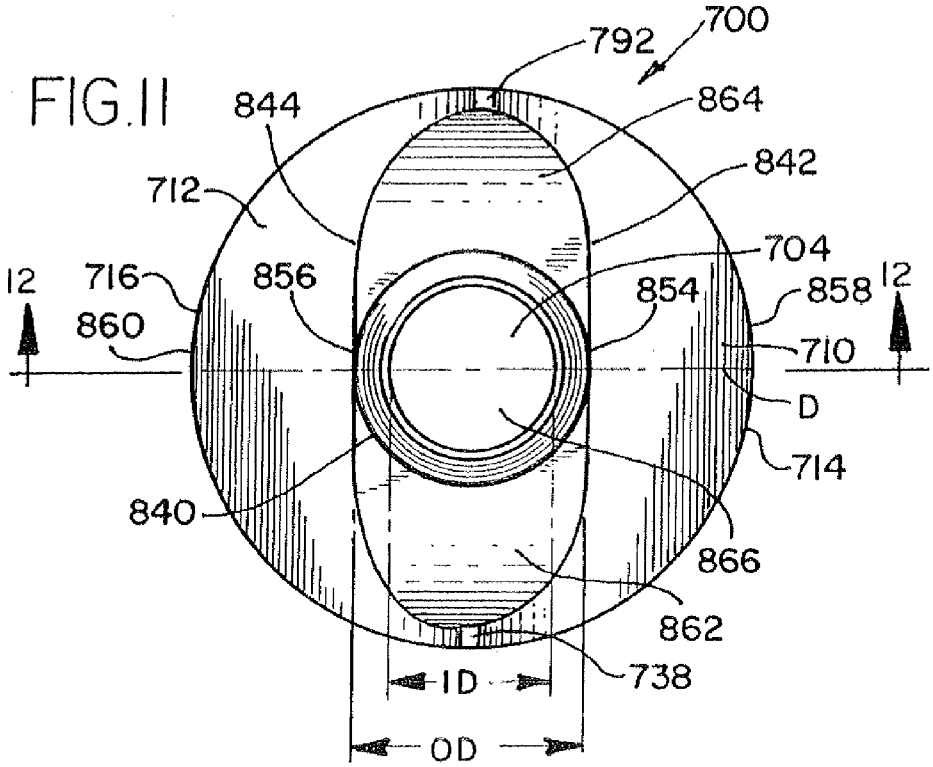
FIG. 11 is a top plan view of the punch of the fourth embodiment as illustrated in FIG. 8.
Figure 12:
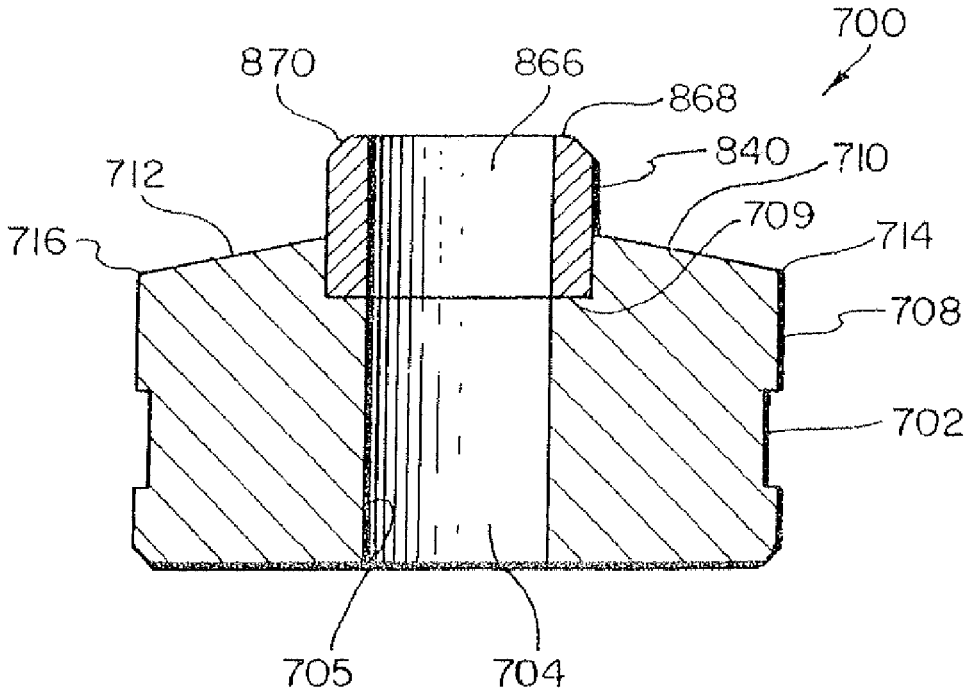
FIG. 12 is a cross-sectional view of the punch of the fourth embodiment taken along line 12-12 of FIG. 11.

A knockout punch is provided. A first embodiment of the knockout punch 100 is illustrated in FIGS. 1-5. A second embodiment of the knockout punch 300 is illustrated in FIG. 6. A third embodiment of the knockout punch 500 is illustrated in FIG. 7. A fourth embodiment of the knockout punch 700 is illustrated in FIGS. 8-13. Like elements are denoted with like reference numerals with the reference numbers denoting the first embodiment being in the one and two hundreds, the reference numbers denoting the second embodiment being in the three and four hundreds, the reference numbers denoting the third embodiment being in the five and six hundreds, and the reference numbers denoting the fourth embodiment being in the seven and eight hundreds.

Each of the punches 100, 300, 500, 700 are useful for punching a hole through a workpiece 20, such as 10-gauge, type 304 stainless steel, which is typically used to form electrical cabinets. The punches 100, 300, 500, 700 are used with a die 22 which is well known in the art as well as a draw stud 24 which is also well known in the art. A first end not shown of the draw stud 24 is typically threaded to a ram (not shown) of a punch driver (not shown). A second end 26 of the draw stud 24 is inserted through the die 22 and through a pilot hole 28 which is provided in the workpiece 20, the draw stud 24 having a circumference that is less than the circumference of the pilot hole 28. The punches 100, 300, 500, 700 are then attached to the second end 26 of the draw stud 24 on the opposite side of the workpiece 20 than is the die 22 and the hydraulic punch driver.

An operator actuates a hand pump of the hydraulic punch driver. When the hand pump of the hydraulic punch driver is actuated, hydraulic fluid forces the ram to pull the draw stud 24. The draw stud 24, in turn, pulls the punch 100, 300, 500, 700 through the electrical cabinet into the die 22 such that the desired hole size is punched.

Attention is now directed to the first embodiment of the punch 100 shown in FIGS. 1-5. The punch 100 includes a generally cylindrical punch body 102 and a punch face 108 having a passageway 104 extending axially therethrough. A wall 106 of the passageway 104 is typically threaded and threadably receives a threaded end of the draw stud in a conventional fashion. The working face 108 has a novel arrangement of inclined surfaces and associated cutting edges and surfaces for centering the punch 100, draw stud and die, which will be referred to collectively as the punch assembly, with the pilot hole, punching through the workpiece, and splitting apart of a slug to be removed from the workpiece.

Figure 5:
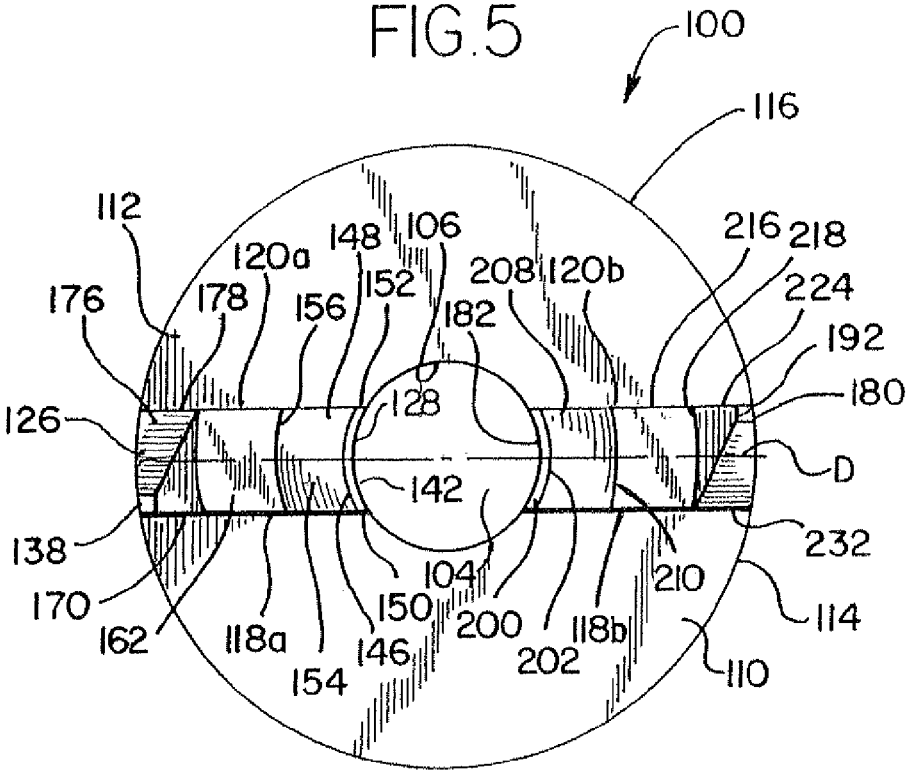
FIG. 5 is a top plan view of the punch of the first embodiment as illustrated in FIG. 2.

The working face 108 includes a pair of inclined planar surfaces 110, 112 on opposite sides of a line D, see FIG. 5, which corresponds to the diameter of the working face 108. The inclined planar surfaces 110, 112 slope upwardly from the punch body 102 in opposite directions at an angle $\alpha$. The inclined planar surfaces 110, 112 have outer circumferential or peripheral edges which form outer cutting edges 114, 116 around a large portion of the working face 108 periphery when viewed in the top plan shown in FIG. 5.

The inclined planar surface 110 has inner ends 118*a*, 118*b* parallel with and spaced from line D across the working face 108 in top plan view with inner edge 118*a* and inner edge 118*b* being on opposite sides of the passageway 104. The inclined planar surface 112 has inner ends 120*a*, 120*b* parallel with and spaced from line D across the working face 108 in top plan view with inner edge 120*a* and inner edge 120*b* being on opposite sides of said passageway 104.

The inclined planar surface 110 inclines at angle $\alpha$ from inner edge 118*a* to inner edge 118*b* such that inner edge 118*b* is positioned higher than the inner edge 118*a*. The inclined planar surface 112 inclines at angle $\alpha$ from inner edge 120*b* to inner edge 120*a* such that inner edge 120*a* is positioned higher than the inner edge 120*b*. ends 118*a*, 120*b* are positioned at the same height while inner ends 118*b*, 120*a* are positioned at the same height.

The working face 108 includes an extension member 122 between the inner ends 118*a*, 120*a* and the passageway 104. Similarly, the working face 108 includes an extension member 124 between the inner ends 118*b*, 120*b* and the passageway 104.

The extension member 122 has an outer peripheral surface 126, an inner surface 128, a first side surface 130 which extends vertically from the inner edge 118*a* between the outer peripheral surface 126 and the inner surface 128, and a second side surface 132 which extends vertically from the inner edge 120*a* between the outer peripheral surface 126 and the inner surface 128.

The outer peripheral surface 126 is defined by first and second outer peripheral edges 134, 136. The first outer peripheral edge 134 extends vertically from an outer end of the inner edge 118*a* to a point 138 which is positioned at a height higher than both the inner edge 118*a* and the inner edge 120*a*. The second outer peripheral edge 136 tapers downwardly from the point 138 to an outer end of the inner edge 120*a*.

The inner surface 128 is defined by first, second and third inner edges 140, 142, 144. The first inner edge 140 extends vertically from an inner end of the inner edge 118*a* to a first end of the second inner edge 142. The third inner edge 144 extends vertically from an inner end of the inner edge 120*a* to a second end of the second inner edge 142. The second inner edge 142 is positioned at a height higher than the point 138, and is preferably positioned at a height of about 1/16 of an inch higher than the point 138. The inner surface 128 is an extension of the wall 106 of the passageway 104 and, therefore, is arced as is the wall 106 of the passageway 104. Thus, the second inner edge 142 is arced.

The extension member 122 has a first top surface 146 which extends horizontally from the second inner edge 142 toward the outer peripheral surface 126 to an outer edge 148. The first top surface 146 is generally arced and, therefore, the outer edge 148 is also generally arced. The first top surface 146 further has a first side edge 150 and a second side edge 152. The first side edge 150 is also an edge of the first side surface 130 while the second side edge 152 is also an edge of the second side surface 132.

The extension member 122 has a second top surface 154 which tapers downwardly and outwardly toward the outer peripheral surface 126 from the outer edge 148 to an outer edge 156. The second top surface 154 is generally arced and, therefore, the outer edge 156 is also generally arced. The second top surface 154 further has a first side edge 158 and a second side edge 160. The first side edge 158 is also an edge of the first side surface 130 while the second side edge 160 is also an edge of the second side surface 132.

The second top surface 154, the first top surface 146 and the inner surface 128 combine to form a tapered projection 161 of the extension member 122.

The extension member 122 has a third top surface 162 which extends horizontally from the outer edge 156 toward the outer peripheral surface 126 to an outer edge 164. The outer edge 164 is generally arced. The third top surface 162 further has a first side edge 166 and a second side edge 168. The first side edge 166 is also an edge of the first side surface 130 while the second side edge 168 is also an edge of the second side surface 132.

The extension member 122 has a fourth top surface 170 which tapers downwardly and inwardly toward the inner surface 128 from the point 138 to the outer edge 164. The fourth top surface 170 tapers downwardly at an angle β relative to an axial line L through the center of the passageway 104. The fourth top surface 170 further has a first side edge 172 and a second side edge 174. The first side edge 172 is also an edge of the first side surface 130.

The extension member 122 has a fifth top surface 176 which tapers downwardly toward the inner edge 120*a* from the point 138 to an edge 178. The edge 178 is also an edge of the second side surface 132. The second side edge 174 and the second outer peripheral edge 136 are the other edges of the fifth top surface 176.

The fourth top surface 170, the fifth top surface 176, the outer peripheral surface 126 and the point 138 combine to form a piercing portion 179 of the extension member 122.

The extension member 124 has an outer peripheral surface 180, an inner surface 182, a first side surface 184 which extends vertically from the inner edge 120*b* between the outer peripheral surface 180 and the inner surface 182, and a second side surface 186 which extends vertically from the inner edge 118*b* between the outer peripheral surface 180 and the inner surface 182.

The outer peripheral surface 180 is defined by first and second outer peripheral edges 188, 190. The first outer peripheral edge 188 extends vertically from an outer end of the inner edge 120*b* to a point 192 which is positioned at a height higher than both the inner edge 120*b* and the inner edge 118*b*. The second outer peripheral edge 190 tapers downwardly from the point 192 to an outer end of the inner edge 118*b*.

The inner surface 182 is defined by first, second and third inner edges 194, 196, 198. The first inner edge 194 extends vertically from an inner end of the inner edge 120*b* to a first end of the second inner edge 196. The third inner edge 198 extends vertically from an inner end of the inner edge 118*b* to a second end of the second inner edge 196. The second inner edge 196 is positioned at a height higher than the point 192, and is preferably positioned at a height of about 1/16 of an inch higher than the point 192. The inner surface 182 is an extension of the wall 106 of the passageway 104 and, therefore, is arced as is the wall 106 of the passageway 104. Thus, the second inner edge 196 is arced.

The extension member 124 has a first top surface 200 which extends horizontally from the second inner edge 196 toward the outer peripheral surface 180 to an outer edge 202. The first top surface 200 is generally arced and, therefore, the outer edge 202 is also generally arced. The first top surface 200 further has a first side edge 204 and a second side edge 206. The first side edge 204 is also an edge of the first side surface 184 while the second side edge 206 is also an edge of the second side surface 186.

The extension member 124 has a second top surface 208 which tapers downwardly and outwardly toward the outer peripheral surface 180 from the outer edge 202 to an outer edge 210. The second top surface 208 is generally arced and, therefore, the outer edge 210 is also generally arced. The second top surface 208 further has a first side edge 212 and a second side edge 214. The first side edge 212 is also an edge of the first side surface 184 while the second side edge 214 is also an edge of the second side surface 186.

The second top surface 208, the first top surface 200 and the inner surface 182 combine to form a tapered projection 215 of the extension member 124.

The extension member 124 has a third top surface 216 which extends horizontally from the outer edge 210 toward the outer peripheral surface 180 to an outer edge 218. The outer edge 218 is generally arced. The third top surface 216 further has a first side edge 220 and a second side edge 222. The first side edge 220 is also an edge of the first side surface 184 while the second side edge 222 is also an edge of the second side surface 186.

The extension member 124 has a fourth top surface 224 which tapers downwardly and inwardly toward the inner surface 182 from the point 192 to the outer edge 218. The fourth top surface 224 tapers downwardly at an angle β relative to the axial line L. The fourth top surface 224 further has a first side edge 226 and a second side edge 228. The first side edge 226 is also an edge of the first side surface 184.

The extension member 124 has a fifth top surface 230 which tapers downwardly toward the inner edge 118*b* from the point 192 to an edge 232. The edge 232 is also an edge of the second side surface 186. The second side edge 228 and the second outer peripheral edge 190 are the other edges of the fifth top surface 230.

The fourth top surface 224, the fifth top surface 230, the outer peripheral surface 180 and the point 192 combine to form a piercing portion 233 of the extension member 224.

The extension members 122, 124 are preferably identical to one another, but are oppositely arranged.

Operation of the punch 100 will now be discussed. As explained above, an operator threads a first end of a draw stud to a ram of a punch driver. A second end of the draw stud is inserted through a die and through a pilot hole which is provided in a workpiece, the draw stud having a circumference which is less than the circumference of the pilot hole. The punch 100 is then attached to the second end of the draw stud on the opposite side of the workpiece than is the die and the hydraulic punch driver. The punch 100 is attached to the draw stud by threading the second end of the draw stud into the passageway 104 of the punch 100 which has a threaded wall 106.

In the preferred embodiment, the operator turns the punch 100 onto the draw stud until the punch 100 and the die are tight on the workpiece and the tapered projections 161, 215, which are positioned adjacent to the draw stud, enter the pilot hole and cause the punch 100, the draw stud and die to center on the pilot hole. The operator could also actuate a hydraulic punch driver until the punch 100 and the die are tight on the workpiece.

After the tapered projections 161, 215 enter the pilot hole to center the punch 100, the operator actuates a hand pump of the hydraulic punch driver such that hydraulic fluid forces the ram to pull the draw stud, which in turn pulls the punch 100, such that the points 138, 192 pierce through the workpiece and the workpiece is cut along the fourth and fifth top surfaces 170, 176; 224, 230.

After the workpiece is cut along the fourth and fifth top surfaces 170, 176; 224, 230, and the points 138, 192 have fully passed through the workpiece, the inclined planar surfaces 110, 112 begin shearing the workpiece to create a hole having a diameter equivalent to the diameter of the working face 108, which is larger than a diameter of the pilot hole. As the points 138, 192 pierce through the workpiece, lateral cutting or splitting of a slug (not shown) is initiated from a slug periphery (defined by the diameter of the working face 108) toward a slug center (defined by the pilot hole through the workpiece) before a significant part of the slug periphery is cut by the outer edges 114, 116 of the inclined planar surfaces 110, 112. With further penetration, lateral splitting of the slug continues and preferably is substantially complete before the outer cutting edges 114, 116 begin cutting their portion of the slug periphery. The entire slug periphery is thus cut and the slug is split apart into two pieces for easy removal from the draw stud and the die.

The configuration of the punch 100, in comparison to punches of the prior art, reduces the initial piercing force by reducing the area of contact between the punch 100 and the workpiece. The two points 138, 192 have steep tapers and are high enough that the points 138, 192 have fully passed through the workpiece before the inclined planar surfaces 110, 112 begin shearing the hole. In prior art punches, the punches work against a greater length of the workpiece before the points fully pass through the workpiece.

The configuration of the punch 100 also maintains a constant shearing angle throughout the punching cycle except for the points 138, 192 used to initially pierce the workpiece. Prior art punches typically have an elevated punching force at the end of the punching cycle. In one prior art punch, the punching force is high because the punch is shearing on four lines simultaneously and the angle of the punch face reduces to zero at the end of the punching cycle. In another prior art punch, the inclined planar surfaces of the punch are "v" shaped, shearing on four lines simultaneously as the angle of the punch face reduces to zero toward the end of the punching cycle.

The configuration of the punch 100 also is advantageous because the punch 100 has only planar surfaces which can be machined with standard cutting tools. Unlike prior art punches, no custom form tools or broaches are required.

FIG. 6 illustrates a second embodiment of the punch 300 where the angle β (not shown) is larger than the angle β as illustrated in FIGS. 1-5 and FIG. 7 illustrates a third embodiment of the punch 500 where the angle β (not shown) is larger than the angle β of the second embodiment of the punch 300. Further discussion of the second and third embodiments of the punches 300, 500, with the larger angles β will not be discussed herein as the remainder of the punches 300, 500 are identical to the punch 100 except with regard to dimensions.

Attention is now directed to the fourth embodiment of the punch 700 shown in FIGS. 8-13. The punch 700 includes a generally cylindrical punch body 702 and a working face 708 having a passageway 704 extending axially therethrough. A wall 705 of the passageway 704 is typically threaded and threadably receives a threaded end 26 of the draw stud 24 in conventional fashion. The working face 708 has an arrangement of inclined surfaces and associated cutting edges. An insert 840 extends from the working face 708 and is permanently fastened into a counterbore 709 of the passageway 704 and is used for centering the punch 700, draw stud 24 and die 22 with the pilot hole 28 prior to the punch 700 punching through the workpiece 20.

The working face 708 includes a pair of inclined planar surfaces 710, 712 on opposite sides of line D, which corresponds to the diameter of the working face 708. The inclined planar surfaces 710, 712 are generally crescent-shaped such that outer circumferential edges 714, 716 of the inclined planar surfaces 710, 712 are convex while the inner edges 842, 844 thereof are concave. The outer circumferential or peripheral edges 714, 716 act as outer cutting edges 714, 716 around a large portion of the periphery of the working face 708 when viewed in the top plan shown in FIG. 11. The inclined planar surfaces 710, 712 slope upwardly from the outer cutting edges 714, 716 to the inner edges 842, 844 of the inclined planar surfaces 710, 712.

The inclined planar surface 710 has a first end 846 and a second end 848. The inclined planar surface 712 has a first end 850 and a second end 852. The first and second ends 846, 848 of the inclined planar surface 710 are positioned at the same height as the first and second ends 850, 852 of the inclined planar surface 712. The first and second ends 846, 850; 848, 852 of the inclined planar surfaces 710, 712 are positioned at a height which is higher than a middle portion 854, 856 of the inner edges 842, 844 of the inclined planar surfaces 710, 712, which in turn, are positioned at a height which is higher than a middle portion 858, 860 of the outer edges 714, 716 of the inclined planar surfaces 710, 712. The middle portion 854, 856 of the inner edges 842, 844 borders the wall 705 of the passageway 704 at the counterbore 709 thereof.

The first end 846 of the inclined planar surface 710 is connected to the second end 852 of the inclined planar surface 712 at a point 738. The second end 848 of the inclined planar surface 710 is connected to the first end 850 of the inclined planar surface 712 at a point 792.

The working face 708 further includes a pair of top surfaces 862, 864. The top surface 862 extends from the point 738 to the wall 705 of the passageway 704 at the counterbore 709 such that the top surface 862 is bordered by the inner edge 842 of the inclined planar surface 710 from the point 738 to the middle portion 854 thereof, the inner edge 844 of the inclined planar surface 712 from the point 738 to the middle portion 856 thereof, and the wall 705 of the passageway 704 at the counterbore 709. The top surface 864 extends from the point 792 to the wall 705 of the passageway 704 at the counterbore 709 such that the top surface 864 is bordered by the inner edge 842 of the inclined planar surface 710 from the point 792 to the middle portion 854 thereof, the inner edge 844 of the inclined planar surface 712 from the point 792 to the middle portion 856 thereof, and the wall 705 of the passageway 704 at the counterbore 709.

The insert 840 is preferably cylindrical and has an aperture 866 therethrough. The insert 840 is capable of being permanently fastened into the counterbore 709 of the punch 700 by press fitting, welding, threading or bolting, or by any other suitable means. The insert 840 extends upwardly from the counterbore 709 to a top 868 thereof. The top 868 of the insert 840 is preferably positioned at a height of about 1/16 of an inch higher than the points 738, 792. The top 868 of the insert 840 further has a chamfered edge 870 from an inner diameter ID of the insert 840 to an outer diameter OD of the insert 840. The chamfered edge 870 preferably angles downwardly and outwardly at an angle between approximately 30 degrees and 45 degrees. The inner diameter ID of the insert 840 is preferably of the same diameter as the passageway 704 of the punch 700 such that the draw stud 24 can also be threaded into the aperture 842 of the insert 840 if required.

Figure 13:
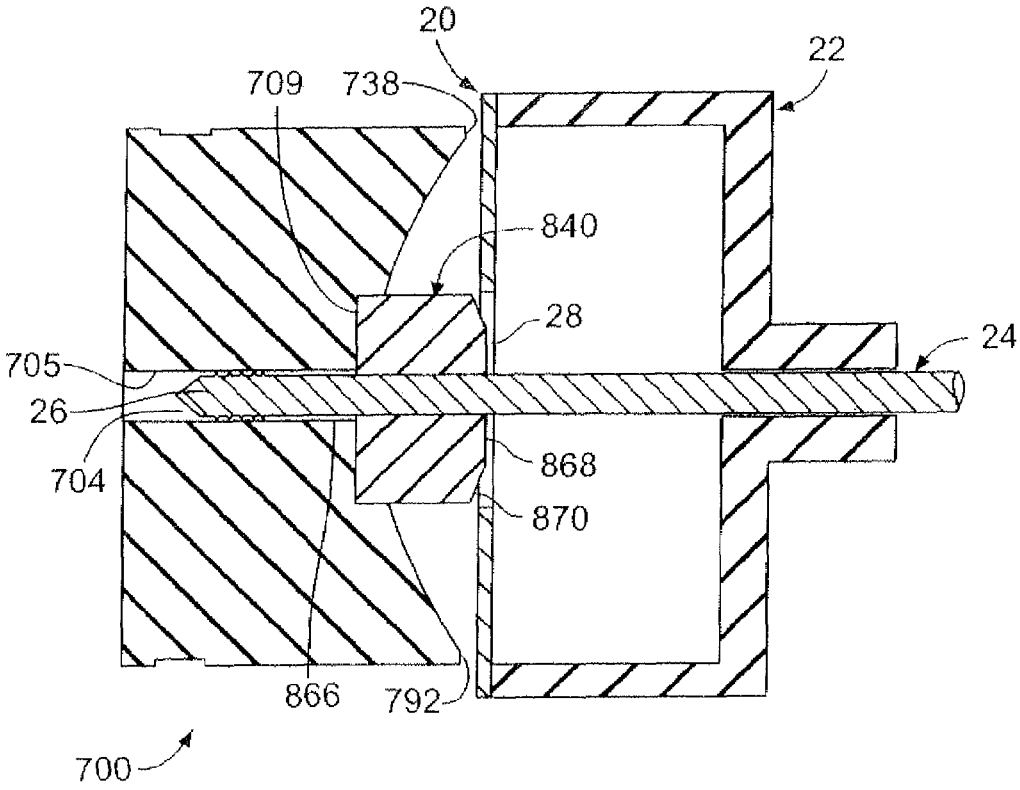
FIG. 13 is a cross-sectional view of the punch of the fourth embodiment being pulled toward the workpiece by a drive member such that the insert member enters the pilot hole of the workpiece to center the punch with the pilot hole of the workpiece.

Operation of the punch 700 will now be discussed. As explained above, an operator threads a first end of a draw stud 24 to a ram of a punch driver. A second end 26 of the draw stud 24 is inserted through a die 22 and through a pilot hole 28 which is provided in a workpiece 20, the draw stud 24 having a circumference which is less than the circumference of the pilot hole 28. The punch 700 is then attached to the second end 26 of the draw stud 24 on the opposite side of the workpiece 20 than is the die 22 and the hydraulic punch driver, as best illustrated in FIG. 13. The punch 700 is attached to the draw stud 24 by threading the second end 26 of the draw stud 24 into the passageway 704 of the punch 700 which has a threaded wall, with the draw stud 24 extending through the insert 840.

In the preferred embodiment, the operator turns the punch 700 onto the draw stud 24 until the punch 700 and die 22 are tight on the workpiece 20 and the chamfered edge 870 of the top 868 of the insert 840, which is positioned adjacent to the draw stud 24, enters the pilot hole 28 causes the punch 700, the draw stud 24 and the die 22 to center on the pilot hole 28, as illustrated in FIG. 13. The operator could also actuate a hydraulic punch driver until the punch 700 and the die 22 are tight on the workpiece 20.

After the insert 840 enters the pilot hole 28 to center the punch 700, the draw stud 24 and the die 22 on the pilot hole 28, the operator actuates a hand pump of the hydraulic punch driver such that hydraulic fluid forces the rain to pull the draw stud 24, which in turn pulls the punch 700 such that the points 738, 792 pierce through the workpiece 20. The inclined planar surfaces 710, 712 begin shearing the workpiece 20 to create a hole having a diameter which is larger than a diameter of the pilot hole 28. A slug is created from the workpiece 20 where the hole is formed and tire slug can be split depending on the configuration of the cutting surfaces.

The points 738, 792 piercing the workpiece 20 before the inclined planar surface 710, 712 shear the workpiece 20, minimizes the required punching force.

In the fourth embodiment, the configuration of the cutting surfaces is not important to the embodiment as long as the cutting surfaces can create a hole having a diameter D, which is larger than a diameter of the pilot hole 28.

The invention is claimed as follows:

1. A punch for cutting a hole in a workpiece, the workpiece having a pilot hole provided therethrough through which an associated drive member is configured to extend, said punch comprising:

a punch body having a bore extending at least partially therethrough and having first and second opposite sides;

at least one piercing portion extending from said first side of said punch body a predetermined distance for piercing the workpiece;

at least one cutting portion extending from said first side of said punch body a predetermined distance for shearing the workpiece after said at least one piercing portion has pierced the workpiece; and an insert member fastened within said bore of said punch body which is configured to center said punch body with the pilot hole of the workpiece, said insert member extending outwardly from said bore from said first side of said punch body, said insert member being a separate member from the associated drive member which is configured to extend through the pilot hole.

2. A punch as defined in claim 1, wherein said insert member has a bore therethrough which is in communication with said bore of said punch body.

3. A punch as defined in claim 1, wherein said insert member extends further outwardly from said first side of said punch body than said at least one piercing portion such that at least a portion of said insert member enters the pilot hole of the workpiece to center said punch body with the pilot hole prior to said at least one piercing portion piercing the workpiece.

4. A punch as defined in claim 1, wherein said insert member is cylindrical.

5. A punch as defined in claim 3, wherein said insert member has first and second ends, said first end of said insert member being fastened within said bore of said punch body, said second end of said insert member having a chamfered edge, said second end extending further away outwardly from said first side of said punch body than said at least one piercing portion such that said chamfered edge enters the pilot hole of the workpiece in order to center said punch body with the pilot hole prior to said at least one piercing portion piercing the workpiece.

6. A punch as defined in claim 5, wherein said edge is chamfered between approximately a 30 degree angle and a 45 degree angle.

7. A punch as defined in claim 5, wherein said second end of said insert member extends approximately 1/16 inch further outwardly from said first side of said punch body than said at least one piercing portion.

8. A punch as defined in claim 5, wherein said punch body has a counterbore in communication with said bore, said first end of said insert member being fastened within said counterbore of said punch body.

9. A punch as defined in claim 1, wherein said at least one piercing portion comprises a pair of piercing portions, said pair of piercing portions are generally positioned opposite each other along an edge of said punch body.

10. A punch as defined in claim 9, wherein said at least one cutting portion comprises a pair of cutting portions, said pair of cutting portions are positioned opposite each other and extend generally from one of said piercing portion to said other of said piercing portions, said cutting portions have cutting edges along said edge of said punch body and extend from said edge of said punch body toward said bore of said punch body.

11. A punch as defined in claim 1, wherein said punch body, said at least one piercing portion and said at least one cutting portion are all integrally formed.

12. A punch as defined in claim 1, wherein said insert member is permanently fastened within said bore of said punch body.

13. A cutting device for cutting a hole in a workpiece, the workpiece having a pilot hole provided therethrough, said cutting device comprising:

a punch having a working face, a bore extending at least partially therethrough which is open to said working face, at least one piercing portion extending outwardly from said working face a predetermined distance, said at least one piercing portion configured to pierce the workpiece, at least one cutting portion extending outwardly from said working face a predetermined distance, said at least one cutting portion configured to shear the workpiece after said at least one piercing portion has pierced the workpiece, and an insert member fastened within said bore of said punch and extending outwardly from said working face a predetermined distance, said insert member configured to center said punch with the pilot hole of the workpiece prior to said at least one piercing portion piercing the workpiece; and a drive member which extends through the pilot bole of the workpiece and which is secured to said punch such that upon actuation of said drive member, said punch is caused to cut the hole in the workpiece by, in series, having said insert member center said punch with the pilot hole of the workpiece, having said at least one piercing portion pierce the workpiece, and having said at least one cutting portion shear the workpiece.

14. A cutting device as defined in claim 13, wherein said insert member has a bore therethrough which is in communication with said bore of said punch, said drive member extending through said bore of said insert member and into said bore of said punch such that said drive nember is secured to said punch.

15. A cutting device as defined in claim 13, wherein said insert member extends further outwardly from said working face of said punch than said at least one piercing portion such that at least a portion of said insert member enters the pilot hole of the workpiece to center said-punch with the pilot hole prior to said at least one piercing portion piercing the workpiece.

16. A cutting device as defined in claim 15, wherein said insert member has first and second ends, said first end of said insert member being fastened within said bore of said punch, said second end of said insert member having a chamfered edge, said second end extending further outwardly from said working face of said punch than said at least one piercing portion such that said chamfered edge enters the pilot hole of the workpiece in order to center said punch with the pilot hole prior to said at least one piercing portion piercing the workpiece.

17. A cutting device as defined in claim 16, wherein said punch has a counterbore in communication with said bore, said first end of said insert member being fastened within said counterbore of said punch.

18. A cutting device as defined in claim 13, wherein said insert member is permanently fastened within said bore of said punch.

* * * * *